US007862009B2

(12) United States Patent
Folk et al.

(10) Patent No.: US 7,862,009 B2
(45) Date of Patent: Jan. 4, 2011

(54) ELECTRIC WINCH MOTOR

(75) Inventors: Robert Folk, Red Deer (CA); Adrian Lachance, Red Deer (CA)

(73) Assignee: Victory Rig Equipment Corporation, Red Deer, Alberta (CA)

( * ) Notice: Subject to any disclaimer, the term of this patent is extended or adjusted under 35 U.S.C. 154(b) by 0 days.

(21) Appl. No.: 11/562,862

(22) Filed: Nov. 22, 2006

(65) Prior Publication Data

US 2008/0116432 A1 May 22, 2008

(51) Int. Cl.
*B66D 1/26* (2006.01)

(52) U.S. Cl. ..... 254/278; 254/362

(58) Field of Classification Search ..... 254/278, 254/342, 362, 371
See application file for complete search history.

(56) References Cited

U.S. PATENT DOCUMENTS

| | | | | |
|---|---|---|---|---|
| 3,788,605 | A | 1/1974 | Johnson | |
| 4,187,546 | A * | 2/1980 | Heffernan et al. | 700/304 |
| 5,018,603 | A | 5/1991 | Ito | |
| 5,760,508 | A * | 6/1998 | Jennings et al. | 310/74 |
| 6,107,714 | A * | 8/2000 | Fischer | 310/77 |
| 6,497,380 | B2 | 12/2002 | Kigawa et al. | |
| 6,601,828 | B2 * | 8/2003 | Strbuncelj et al. | 254/266 |
| 6,903,471 | B2 * | 6/2005 | Arimitsu et al. | 310/59 |
| 7,185,881 | B2 * | 3/2007 | Drarvik et al. | 254/267 |
| 7,273,133 | B2 * | 9/2007 | Hisamitsu | 187/254 |
| 7,451,963 | B2 * | 11/2008 | Finkenbusch et al. | 254/278 |
| 7,538,458 | B2 * | 5/2009 | Soitu | 310/58 |
| 2005/0258701 | A1 * | 11/2005 | Soitu | 310/179 |
| 2008/0006803 | A1 * | 1/2008 | Finkenbusch et al. | 254/266 |

FOREIGN PATENT DOCUMENTS

| | | |
|---|---|---|
| CA | 626168 | 8/1961 |
| CA | 757944 | 5/1967 |
| CA | 811496 | 4/1969 |
| CA | 912860 | 11/1972 |
| CA | 1036150 | 8/1978 |
| CA | 1064898 | 10/1979 |
| CA | 1085575 | 7/1980 |
| CA | 1120026 | 3/1982 |
| CA | 1136733 | 11/1982 |
| CA | 1282730 | 4/1991 |
| CA | 1317126 | 5/1993 |
| CA | 2365249 | 5/2001 |
| CA | 2418589 | 8/2003 |
| CA | 2477377 | 9/2003 |
| CA | 2275599 | 10/2003 |
| CA | 2298730 | 4/2004 |
| CA | 2540257 | 4/2005 |

* cited by examiner

*Primary Examiner*—Emmanuel M Marcelo
(74) *Attorney, Agent, or Firm*—Bennett Jones LLP

(57) ABSTRACT

A winch includes an electric motor having a fixed stator, and a cylindrical rotor which rotates about the stator. A drum is affixed to the rotor and carries the cable which is wound or unwound by the winch. The winch may be a drawworks for an oil and gas rig.

4 Claims, 9 Drawing Sheets

ELECTRIC WINCH MOTOR

FIELD OF THE INVENTION

The present invention relates to an electric winch for winding and unwinding cable, and in particular to a winch having an internal electric motor and to a method of raising and lowering down hole equipment using the winch.

BACKGROUND

Winches used in commercial applications are generally constructed and operated in a similar manner. The basic elements comprise a large-diameter steel spool or drum, brakes, a power source and assorted auxiliary devices. The primary function of the winch is to reel out and reel in the cable, in a controlled fashion by rotating the drum. The reeling out of the cable is largely powered by gravity. The reeling in of the cable is powered by the power source that is usually an electric motor or diesel engine, which is coupled to an intermediary gearing or drive system.

An example of a winch used in a commercial application is a drawworks used in oilfield drilling. The drawworks is a winch found on an oil rig on or below the rig deck. The primary function of the drawworks is to wind in and unwind the drilling line, a large diameter wire rope, as required. The drilling line is reeled over a crown block and traveling block to gain mechanical advantage in a "block and tackle" or "pulley" fashion. This reeling out and in of the drilling line causes the traveling block, and whatever may be hanging underneath it, to be lowered into or raised out of the well bore.

Conventional commercial winches, such as a drawworks winch, have the power source configured in an indirect drive manner with the power source positioned adjacent to the drum. The power source is connected to one or more gearboxes in a variety of ways including the use of drive shafts, couplings, transmissions or clutches. The gearbox in turn is connected to the drum using chain drives or other conventional drive mechanisms. Such indirect drive conventional drawworks systems have a number of disadvantages. First, an external power source occupies more space. In the context of the drawworks winch, the extra space required for the power source makes it difficult to place the drawworks in an optimal position on the already crowded oil rig. External power sources are noisy and can present a hazard to those working around them. Further, conventional winch systems, in particular the gearbox of conventional systems, require frequent maintenance and must be lubricated regularly. Many conventional winches employ complex lubrication systems for the drum and gearbox that require heating systems for the winter and cooling systems for the summer. Also, during the transmission of power through the indirect drive system, there are significant energy losses and a resulting inefficiency associated therewith.

Prior art suggestions at improved winches have been largely focused on providing sophisticated gearing mechanisms to use with the remote power source, and on improved braking systems to try and increase the safety of the winch systems. However, such suggestions do not address the previously described disadvantages and limitations of conventional winch systems.

SUMMARY OF THE INVENTION

The present invention is directed to an electric winch for winding and unwinding cable, and in particular to a winch having an internal electric motor, and to a method of positioning an electric motor within the drum of a winch.

Accordingly, in one aspect of the invention, the invention comprises a drawworks for winding and unwinding drilling cable comprising:

(a) a fixed, non-rotating shaft, whereby the shaft is supported at each end by support means;

(b) an electric motor comprising:

(c) a stator fixed to the shaft;

(d) a rotor rotating about the stator, the rotor forming a drum for winding cable;

(e) bearing means between the motor stator and the motor rotor;

(f) means for connecting the electric motor to a source of electricity; and (g) at least one brake for stopping the rotor.

In one embodiment, the motor may have a cooling system. In one embodiment, the motor may be an AC induction electric motor, a D/C traction electric motor, a DC switch reluctant motor or a permanent magnet electric motor. In a further embodiment, the shaft may be hollow with power cables and coolant hoses running through the hollow shaft to the stator.

In another aspect, the invention comprises a drawworks having an internal electric motor for use on an oil rig, the drawworks comprising;

(a) a fixed, non rotating shaft supported at each end by a pedestal;

(b) an electric motor comprising:

(i) a stator fixed to the shaft;

(ii) a rotor rotating about the stator, the rotor forming a drum for winding drilling cable;

(c) bearing means between the motor stator and the motor rotor; and (d) at least one brake for stopping the rotor.

In another aspect, the invention comprises a method of raising and lowering down hole equipment with a drilling or service rig using a drawworks comprising a winch as described herein.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

Scope

The present invention provides for an electric winch for winding and unwinding cable, and in particular, to a winch having an internal electric motor. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Definitions

In this patent the following words are intended to have the following meaning:

"AC" shall mean alternating current.

"DC" shall mean direct current.

"rotor" shall mean the rotating part of an electric motor.

"stator" shall mean the stationary part of an electric motor.

Description

The present invention is directed to a winch apparatus and to a method of raising and lowering down hole equipment using the winch.

Figure 1:
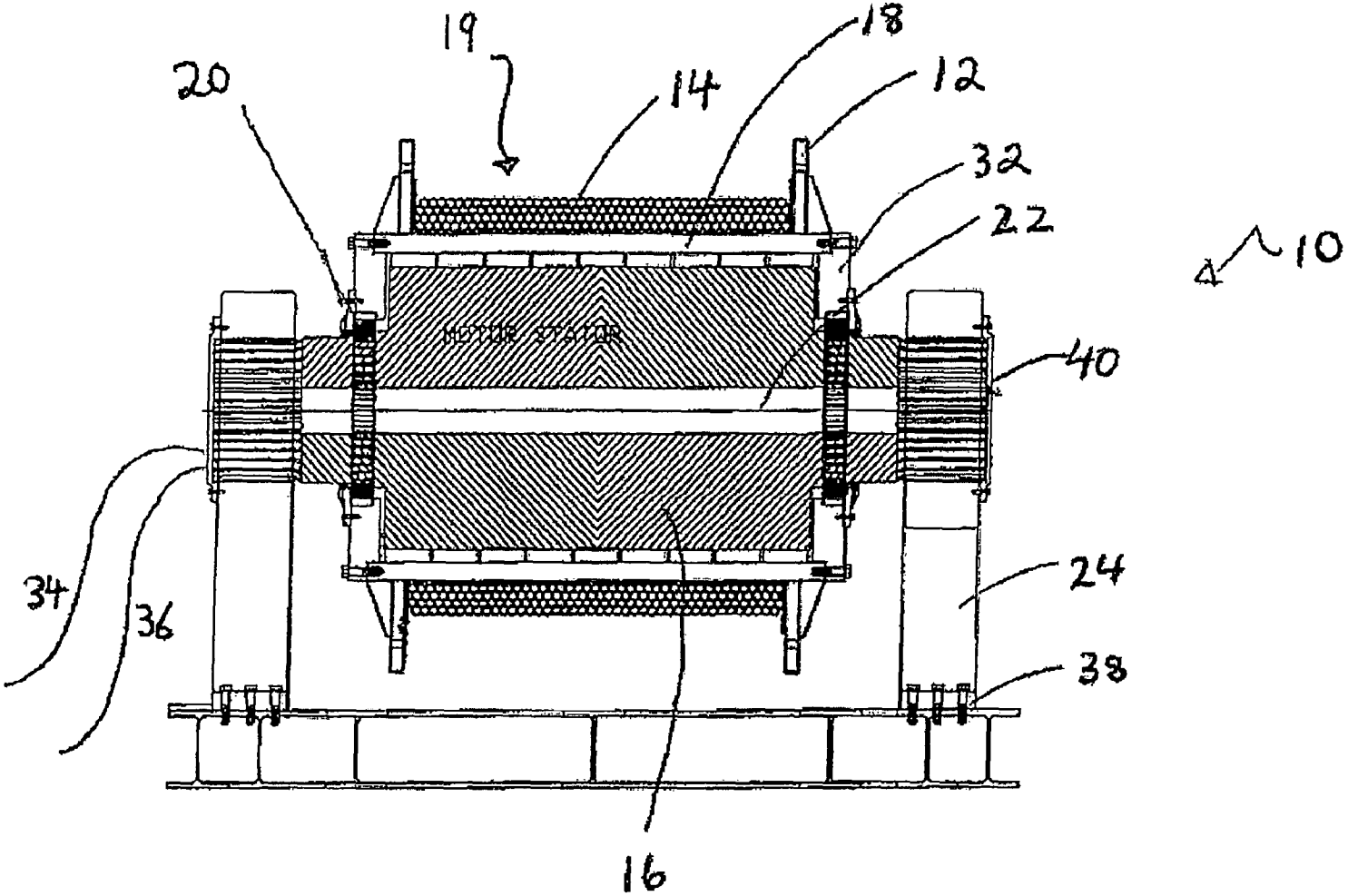
FIG. 1 is a diagrammatic front view of one embodiment of the present invention.
Figure 2:
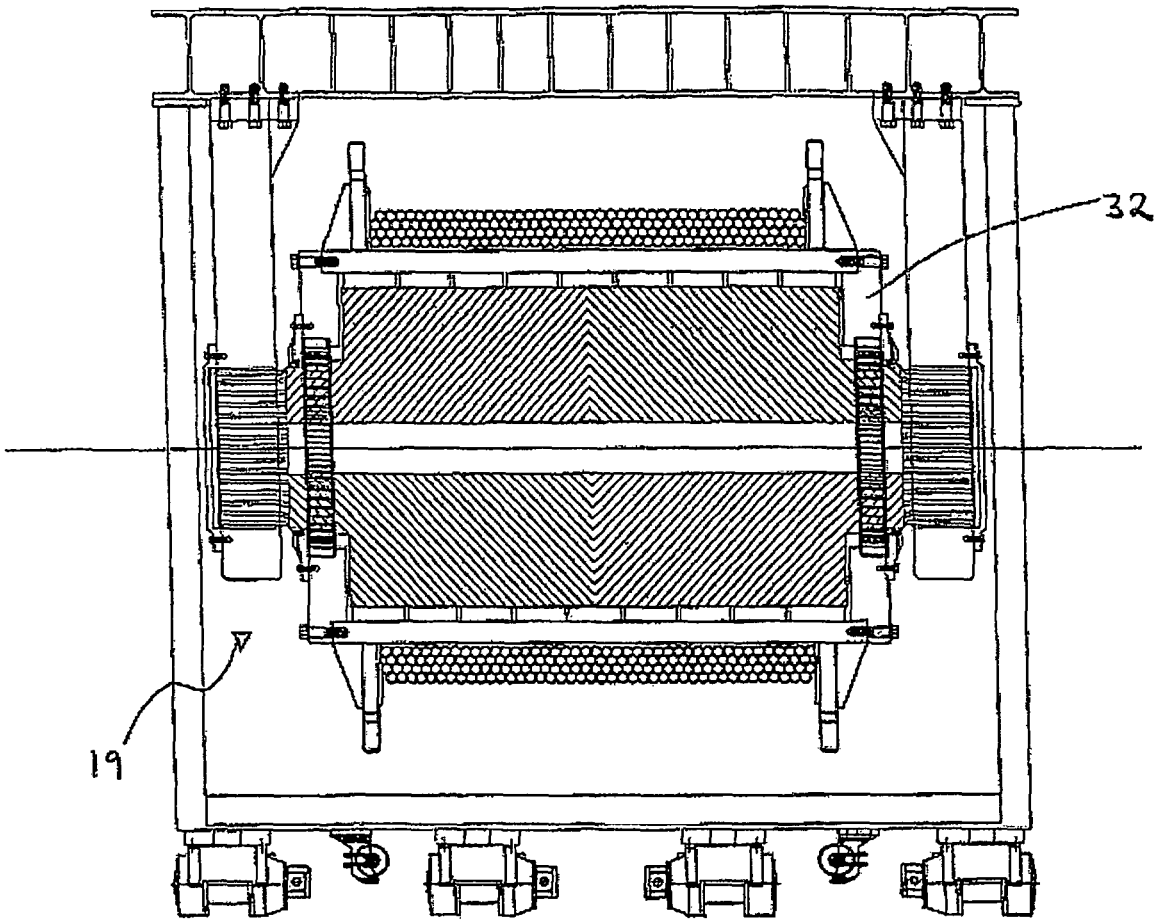
FIG. 2 is a diagrammatic front view of one embodiment of the present invention.
Figure 3:
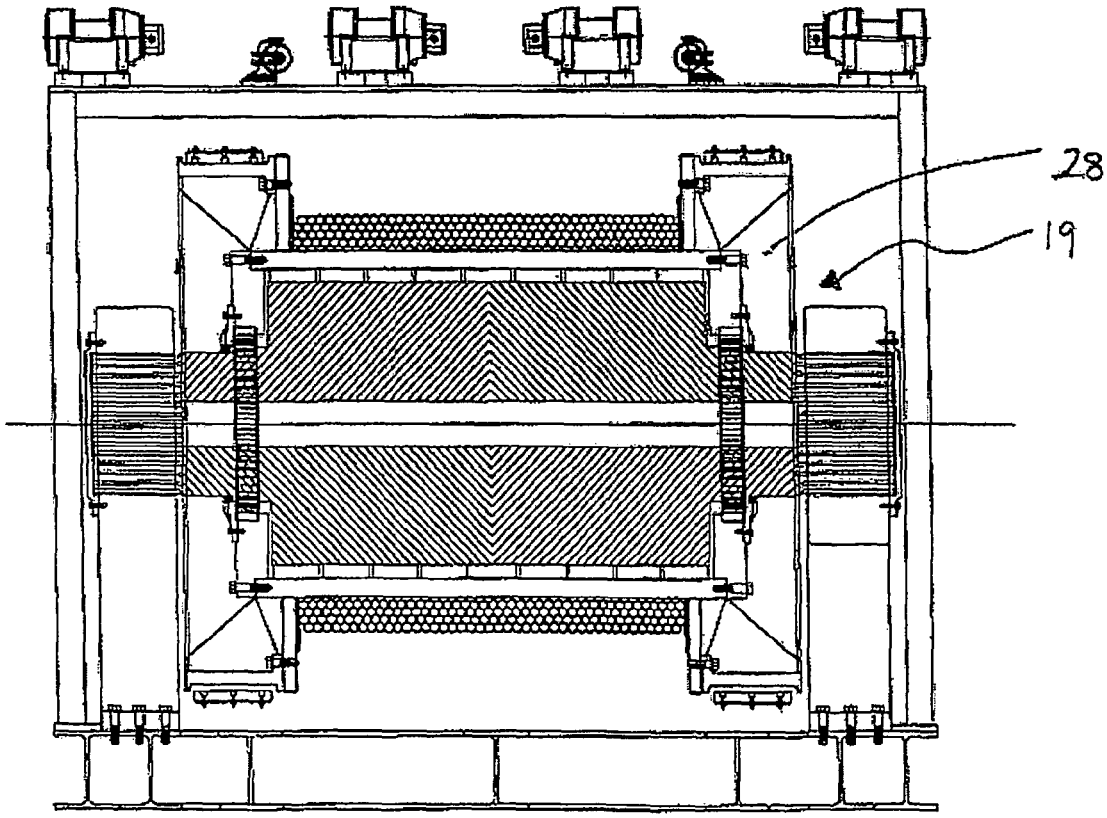
FIG. 3 is a diagrammatic front view of one embodiment of the present invention.

As depicted in FIGS. 1, 2 and 3, the winch (10) has a fixed non-rotating shaft shaft (22). An electric motor stator (16) is fixed to the shaft (22). The shaft (22) and the motor stator (16) are supported at each end by suitable support means (24). As shown in the Figures, pedestals are suitable for supporting the shaft (22) and stator (16). The pedestals are fixed to a stable surface such as a drilling deck (26) or lower level substructure by any suitable means as would be selected by one skilled in the art, including bolts (38) as shown in FIG. 1, or by welded joints. The use of bolts, or other removable attachment means, allows the disassembly and removal of the pedestals (24) and winch (10) if required. It also facilitates the replacement of a damaged pedestal (24) or engine or drum component if required. The shaft (22) and support means (24) may be constructed from any suitable material but must be strong enough to support the combined weight of the motor stator (16), the rotor (18), the drum (12) and the cable (14) and must be able also be strong enough to withstand the torque placed on them by virtue of the rotating motor and the braking loads exerted by the cable (14) during winding and unwinding operations. Iron alloys and steel alloys have been found to be suitable.

Figure 5:
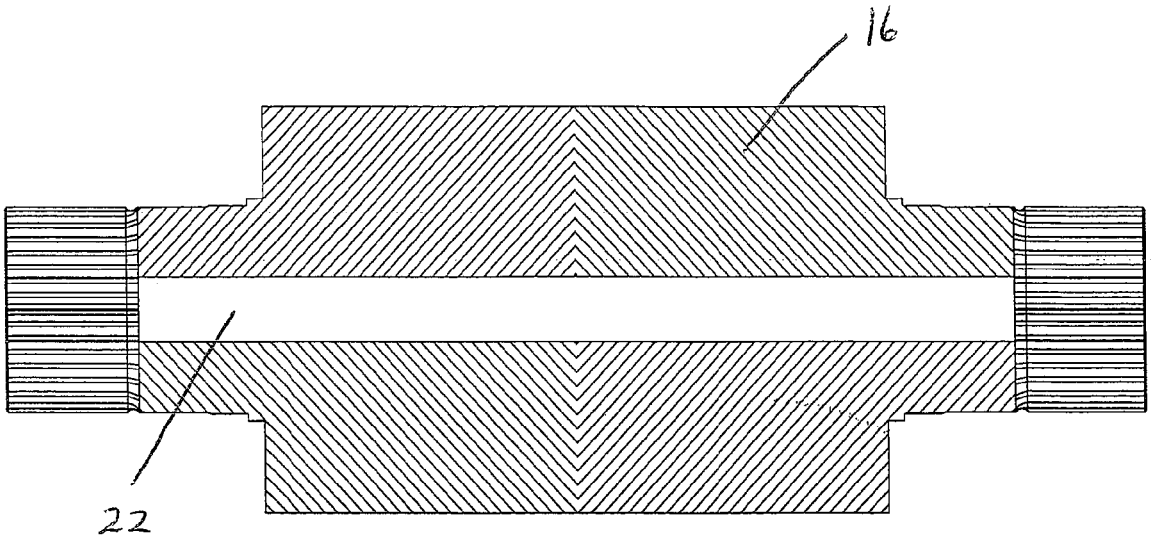
FIG. 5 is a diagrammatic depiction of the stator and central shaft of one embodiment of the present invention.
Figure 6:
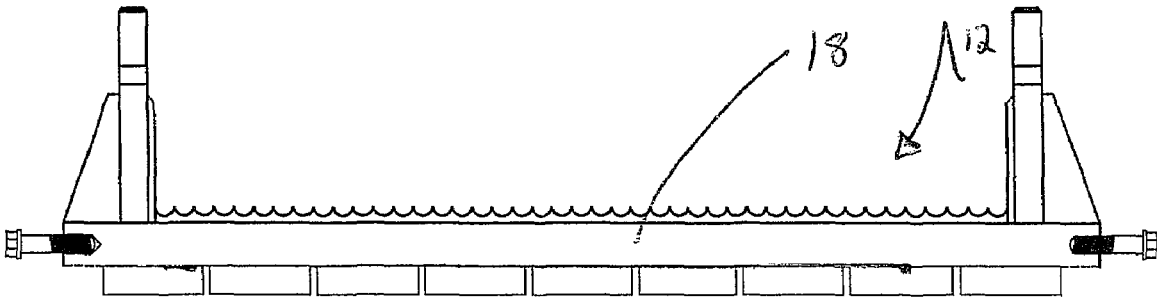
FIG. 6 is a diagrammatic front view of the rotor and drum of one embodiment of the present invention.
Figure 7:
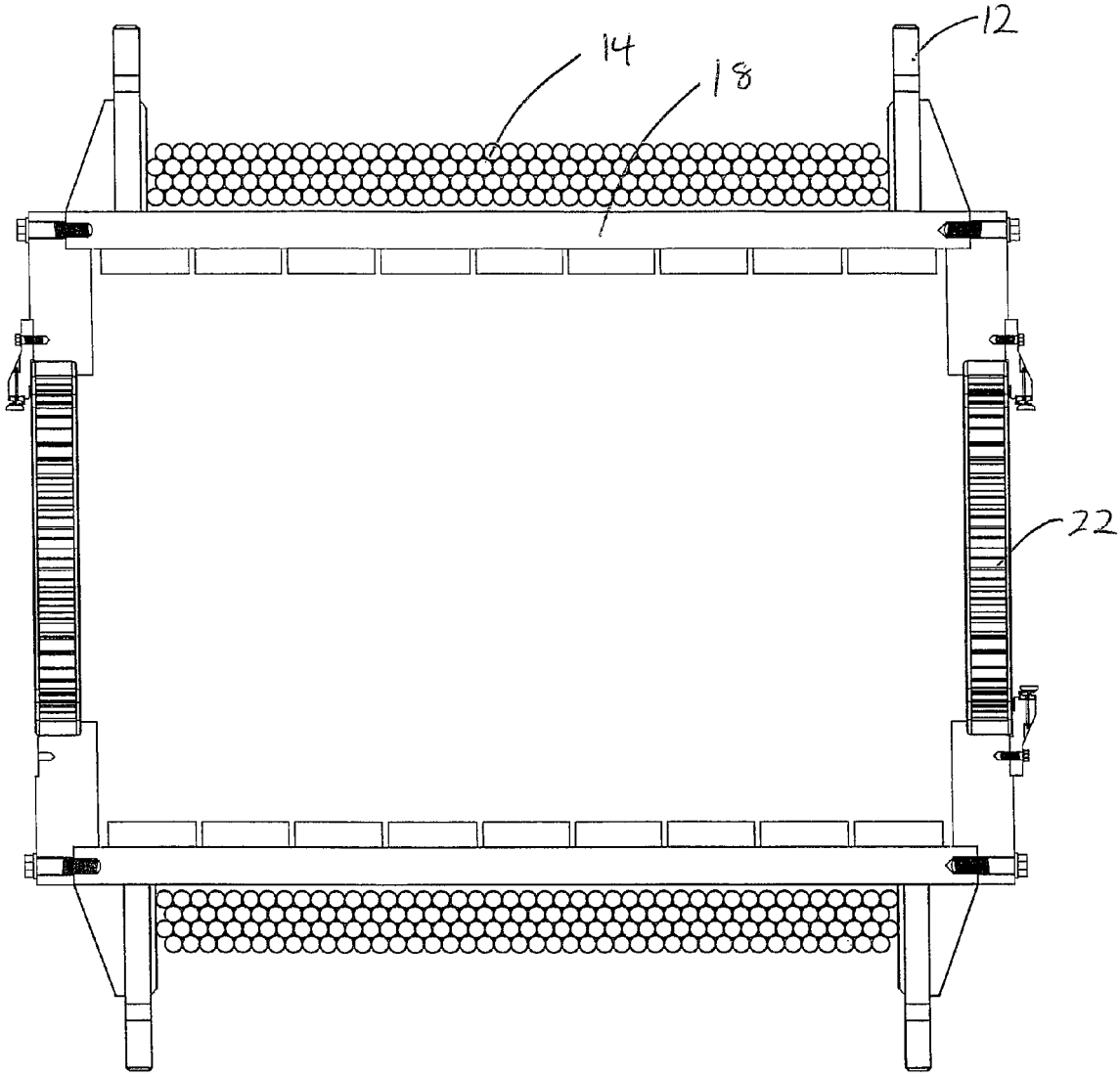
FIG. 7 is a diagrammatic front view of the rotor and drum of one embodiment of the present invention.
Figure 8:
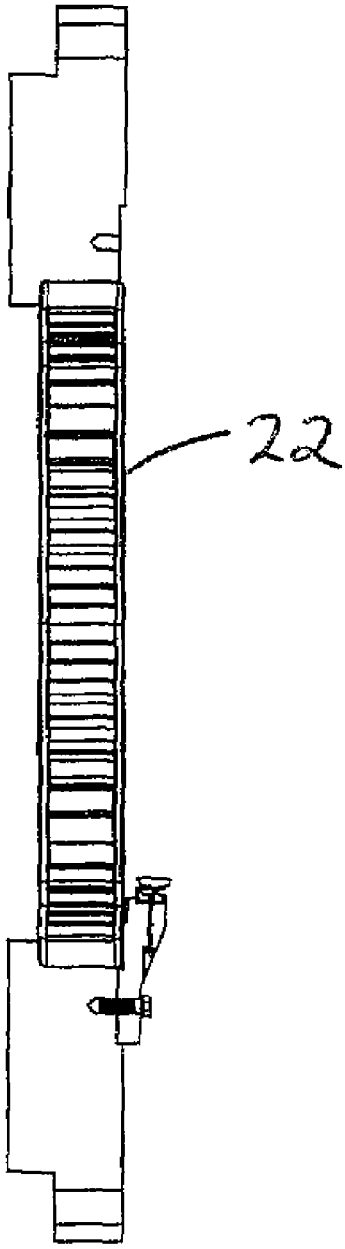
FIG. 8 is a diagrammatic depiction of the bearings of one embodiment of the present invention.
Figure 9:
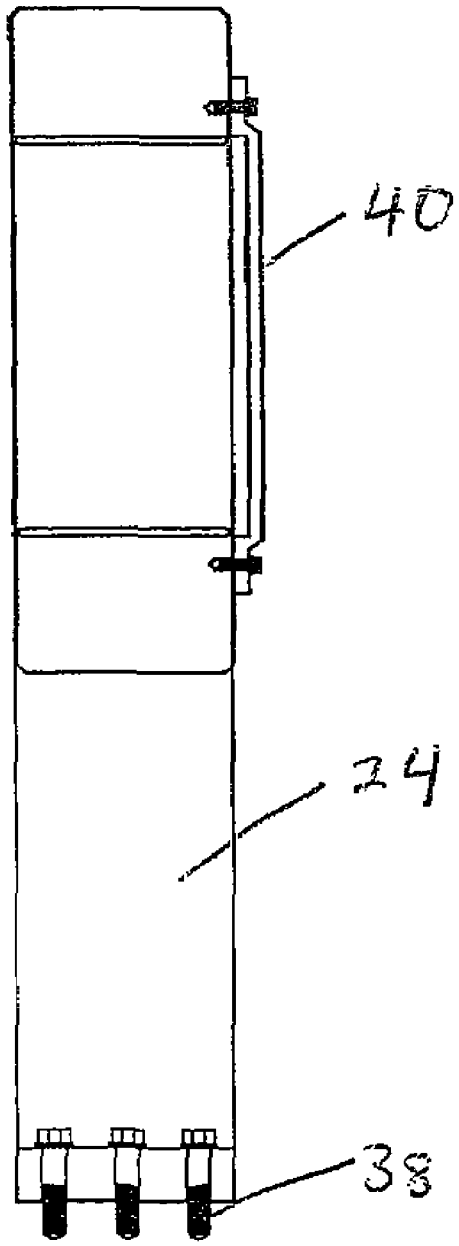
FIG. 9 is a diagrammatic depiction of the pedestals of one embodiment of the present invention.

As shown in FIGS. 5 and 9, the support means (24) and the ends of the shaft (22) and motor stator (16) may be coupled and the stator and shaft held in place using a splined system. However, any other suitable coupling or restraint system that prevents movement of the shaft (22) and stator (16) may be employed including without limitation, ring fetters, bolts and flanges, or any combination of the same. End protectors (40) can be used to protect the connection between the stator (16), the shaft (22) and the support means (24). Neither the shaft (22), nor the stator (16), rotates and are held still by the support means (24) in a fixed manner. The shaft may be solid or hollow. As shown in FIG. 1, a power cable (34) and coolant hoses (36) or air ducts (not shown) can be run through the end of the shaft to the motor stator (16). In the case of a hollow shaft, the cable, hoses or ducts, as the case may be, run through the internal space of the shaft to the stator. In the case of a solid shaft, preformed insulated channels running through the shaft may be used to convey hoses, cables or ducts, as the case may be, to the stator.

The winch is optionally shrouded with guard plates (not shown in the Figures), which may be constructed from any suitable metallic material including twin plate steel.

The electric motor may preferably have a coolant system (not shown in the Figures) for cooling the electric motor. The coolant system can be a liquid-cooled system or an air-cooled system depending on the needs of the electric motor. In one embodiment employing a liquid cooled system, coolant is held in a reservoir and is then pumped through filters to a coolant hose that supplies that stator (16). As shown in FIG. 1, the coolant hose (36) can run through a hollow shaft (22) connecting to the stator (16) at a central position. Alternatively, the coolant hose could run through channels in a solid shaft, or, in the further alternative, the coolant hose does not have to run through the shaft and can connect to the stator in proximity to the support means (24). The coolant is circulated through the stator (16) through tubes drawing heat from the stator (16). With a liquid cooled system, the coolant is circulated through the stator and not through the rotor (18) or any other components such as the stator windings. The heated coolant is removed from the stator (16) using a return hose or tube (36), or a plurality of hoses, and is cooled using a cooling radiator or shell and tube cooler system. After being cooled, the coolant is returned to the reservoir. The system has a pump to circulate the coolant and has flow, and temperature controls and monitors. Dependant on the operation climate, the coolant may be a water/glycol mix, or the coolant may predominantly be comprised of an inhibitor to minimize corrosion.

The stator (16) and rotor (18) can also be air cooled by force blowing large volumes of air across these components. An inlet can be created using a plate at one side of the stator at a position proximate to the bearings (20) and an outlet may be created at the other end in a similar manner. Air that has been filtered to remove debris and particles is passed across the stator (16) and rotor (18) using a fan from the inlet to the outlet, thereby cooling the motor.

The rotor (18) rotates about the longitudinal axis of the stator (16) and the shaft (18). The outer surface of the rotor (18) is formed to create a drum (12) for winding and unwinding cable (14). Alternatively, the rotor and the drum may be separate components with the drum (12) being mounted to the outside of the rotor (18). Therefore, it can be seen that the present invention comprises a direct drive winch system that does not rely on an external power source, a drive shaft or gearing system as found in conventional winches. The power source, namely an electric motor, is located inside the drum (12).

The drum (12) of the present invention may be the same size as a conventional drum or it may be larger than a conventional winch drum. As shown in the Figures, the drum (12) has grooving to assist with the alignment of the cable. The grooving may be cut into the drum itself, or may be casted onto the drum. Any suitable material may be used for the grooving, however the inventors have found 4130 HTDR, 4140 HTSR or 4330 vanadium modified steel alloys to be well suited. The electric winch (10) of the present invention is quieter than conventional winches with external power sources and furthermore, it is more compact requiring less space.

The use of a larger drum generates greater torque and the larger drum rotates more slowly than a smaller conventional drum. The slower rotation speed and reduced cable turns greatly reduces the wear on the cable and extends its useful life. With a conventional drawworks, the use of a larger drum would require a larger motor or a greater gear ratio to rotate the drum, however with the present invention, the internal electric motor in its direct drive configuration generates ample torque to turn the larger drum.

The motor (19) comprises a stator (16) and a rotor (18). Any suitable electric motor may be used, including without limitation, an AC induction motor, a DC traction motor, a DC switch reluctant motor or a permanent magnet motor. As shown in the Figures, there may preferably be an air gap between the rotor and the stator. In one embodiment, because there is no gearing system being utilized, the electric motor selected must be able to generate sufficient torque for the intended application. The electric motor is connected to a source of electricity using insulated cables, or any other suitable means commonly employed by those skilled in the art.

A conventional drawworks has numerous heavy moving intermediary components including, the motor itself, the drive shaft, the gear box, the cable drum, the gear box bearings, the drum bearings, and the drawworks shaft. The cumulative inertial movement leads to inefficiency and wasted energy. The direct drive system of the present invention transfers power directly to the drum and is much more efficient. There are far less moving parts and the winch is much lighter; therefore there is less energy loss. The lighter drawworks of the present invention, having less inertial movement, makes it well suited for offshore drilling operations subject to heave and wave forces.

The rotor (18) rotates about the stator (16) on bearings (20) found at each end of the stator. Any appropriate bearing system as would be commonly used by one skilled in the art may be used in the electric winch of the present invention including without limitation, roller bearings, angular contact bearings, spherical bearings, ceramic bearings, plain bearings and magnetic bearings. The bearing assembly is sealed to prevent the entry of debris or foreign matter into the space between the stator (16) and the rotor (18). The electric winch has inspection ports (32) for checking that the bearings are appropriately greased. Unlike conventional winch systems, the electric winch of the present invention requires comparatively minimal greasing and lubrication and further, it requires less maintenance than a conventional winch system. With a sealed bearing system, the system only requires greasing approximately twice a year. If a magnetic bearing system is used, no such maintenance is required.

Figure 4:
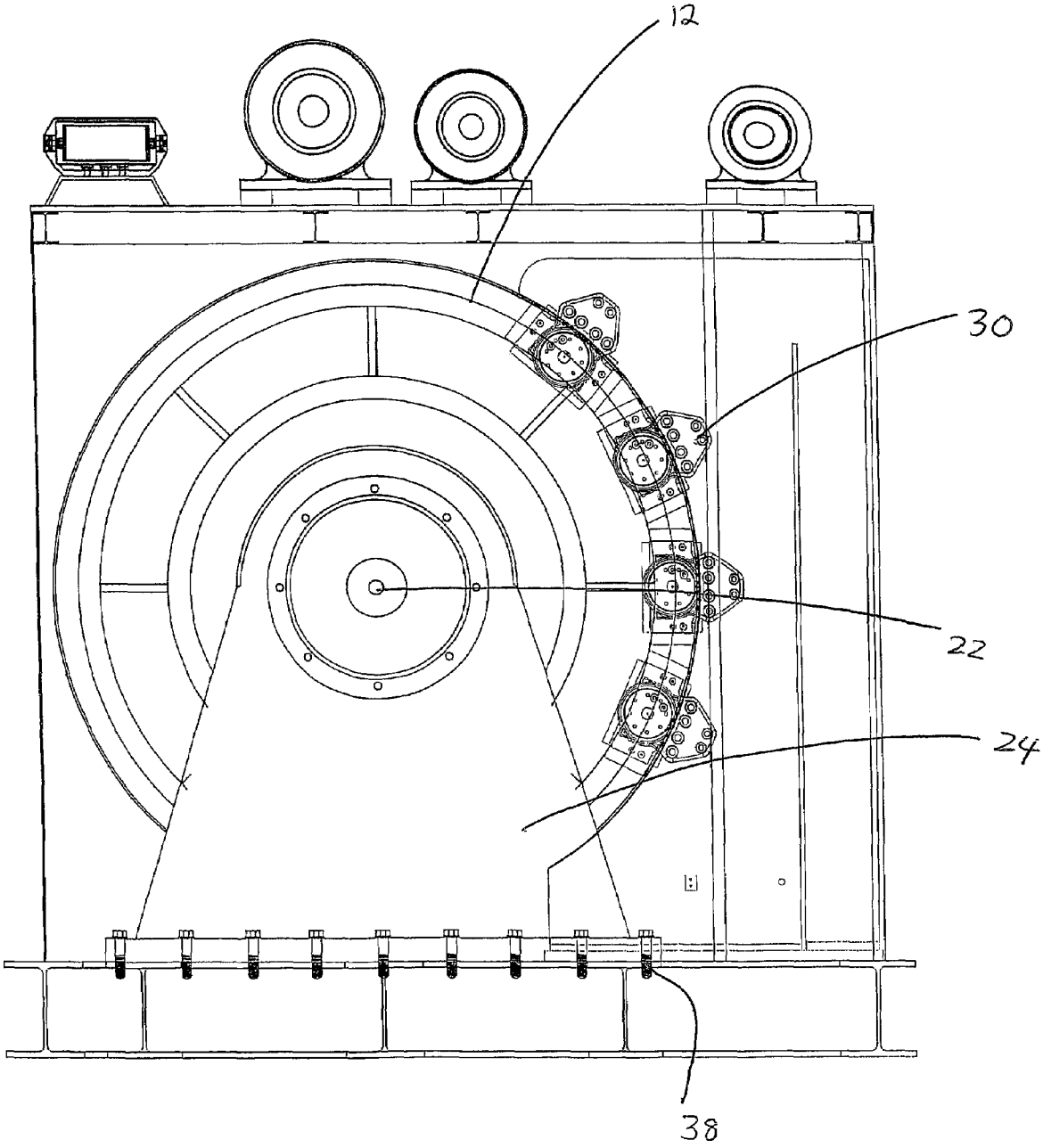
FIG. 4 is a diagrammatic end view of one embodiment of the present invention

Unlike a conventional winch system, the electric motor (19) is used for all of the braking of the drum (12) however, in the event of a loss of power supply, such as a brown out or black out, separate emergency brakes would be applied. Any suitable types of brakes may be used with the drawworks of the present invention for such emergencies including without limitation, band brakes, caliper brakes, Eaton brakes, water cooled brakes or disc brakes. FIG. 3 shows a winch with band brakes (28). FIG. 4 shows an end view of the drum (14) with caliper brakes (30). The brakes can also be used in a parking brake type manner if desired.

When the electric winch is used as a drawworks winch for winding and unwinding drilling line to raise and lower down hole equipment, there are a number of advantages. The drawworks is smaller and lighter taking less space on the drilling deck. This also allows the drawworks to be placed closer to the borehole or, alternatively, further away from the bore hole. If placed further away, this provides for a larger workspace for the rig hands to work and allows the placement of additional equipment such as an iron roughneck. The drill hands are not exposed to the danger of an external power source and the drawworks is much quieter, again creating a safer work environment. The drawworks using the electric winch of the present invention does not require a lubrication system and requires comparatively less maintenance. The drawworks of the present invention is light enough to leave in the substructure when a rig is moved from well to well, and it small enough that it can be placed in positions that conventional drawworks cannot be placed in, such as between the A-legs of a rig, further back in the rig substructure, or on matting pinned to the substructure.

The elements of the winch of the present invention may be constructed from any suitable materials including without limitation steel and iron and alloy mixtures of the same. Any materials used must be able to withstand the wear and torque that they will be subjected to as part of a winch system.

Although the electric winch of the present invention has been described in the context of a drawworks, it should be understood that it can be used in any suitable commercial application such as cranes, hoists and elevator motors.

As will be apparent to those skilled in the art, various modifications, adaptations and variations of the foregoing specific disclosure can be made without departing from the scope of the invention claimed herein.

What is claimed is:

1. A method of lowering and raising down hole equipment into and out of a wellbore with a drilling or service rig comprising the steps of:

(a) providing a drawworks comprising a fixed, non-rotating shaft supported at each end by a pedestal, an internal electric motor comprising a stator fixed to the shaft and a rotor rotating about the stator, the rotor forming a drum, a bearing between the stator and the rotor;

(b) unwinding drilling cable from the drum to lower down hole equipment by powering the electric motor, wherein the drilling cable is routed around the drilling or service rig and is attached to a travelling block from which down hole equipment is suspended; and (c) winding drilling cable onto the drum by reversing the direction of the electric motor, in order to raise down hole equipment.

2. The method of claim 1 further comprising the step of activating a braking system to slow down or stop the winding or unwinding of drilling cable if power to the electric motor is lost or disconnected.

3. The method of claim 1 further comprising the step of cooling the electric motor by passing a liquid or gaseous coolant through the stator.

4. The method of claim 1 wherein the electric motor is an AC induction motor, a DC traction motor, a DC switch motor, or a permanent magnet motor.

* * * * *